US005231243A

United States Patent [19]

Lescure

[11] Patent Number: 5,231,243

[45] Date of Patent: Jul. 27, 1993

[54] CONTROL AND SAFETY DEVICE FOR AN EXTERNALLY POWERED AUTOMATIC WEAPON

[75] Inventor: Jean-Francois Lescure, Bourges, France

[73] Assignee: Giat Industries, Versailles Cedex, France

[21] Appl. No.: 900,439

[22] Filed: Jun. 18, 1992

[30] Foreign Application Priority Data

Jun. 18, 1991 [FR] France ..... 91 07453

[51] Int. Cl.[5] ..... F41A 7/00

[52] U.S. Cl. ..... 89/9; 89/11

[58] Field of Search ..... 89/9, 11, 12, 13.05, 89/13.1

[56] References Cited

U.S. PATENT DOCUMENTS 4,154,143 5/1979 Pechamat et al. ..... 89/11
4,193,335 3/1980 Tassie ..... 89/11
4,481,859 11/1984 Dix ..... 89/12
4,508,006 4/1985 Post et al. ..... 89/9
4,550,641 11/1985 Bruderer et al. ..... 89/12
4,699,040 10/1987 Menges ..... 89/9
4,841,835 6/1989 Bohler et al. ..... 89/12
5,127,309 7/1992 Menges et al. ..... 89/11

FOREIGN PATENT DOCUMENTS 0063680 11/1982 European Pat. Off. .
0124072 11/1984 European Pat. Off. .

*Primary Examiner*—David H. Brown
*Attorney, Agent, or Firm*—Oliff & Berridge

[57] ABSTRACT

Control and safety device for an externally powered automatic weapon include at least one rotor driven by a motor and have a stop cooperating with a locking part. The device has both a detent lever to control firing and a second lever subjected to the action of a rotating finger driven by the recoil of the weapon. The detent lever and the second lever are connected to the locking part by a system of slides and links which automatically stop the rotor by way of the locking part if ammunition should malfunction.

9 Claims, 4 Drawing Sheets

CONTROL AND SAFETY DEVICE FOR AN EXTERNALLY POWERED AUTOMATIC WEAPON

BACKGROUND OF THE INVENTION

The invention relates to a control and safety device for an externally powered automatic weapon comprising a motor, electric, hydraulic, or pneumatic for example, to drive moving parts that supply the weapon with ammunition, fire the ammunition, and eject the shells after firing the ammunition, at a rate which may be relatively high, for example on the order of several hundred rounds per minute.

In self-powered automatic weapons, the energy necessary for operation is supplied either by the ammunition itself when it is fired (by tapping gas), or by the recoil of the weapon, and automatic safety is conferred by the fact that, as long as no ammunition is fired, no energy is available to actuate the moving parts of the weapon.

On the contrary, in the case of an externally powered weapon, movement of the moving parts is independent of ammunition firing, and special means must be provided to lock the moving parts, preventing, for example, opening of the bolt mechanism for a specific time interval when ammunition has not operated correctly after firing ("hang fire" safety device).

For this purpose, means are provided to lock the moving parts of the weapon when ammunition is fed, and unlocking of these moving parts being ensured automatically when ammunition is fired (by tapping gas or by the recoil of the weapon). If the ammunition does not function, the moving parts of the weapon remain locked and the weapon must be reset to eject the unfired ammunition and resume firing.

Hence, externally powered automatic weapons are generally equipped both with a firing control system comprising at least one actuator and an element which stops or locks the moving parts of the weapon, and with a "hang fire" safety system which also comprises an actuator and an element which stops or locks the moving parts of the weapon.

SUMMARY OF THE INVENTION

A goal of the present invention is in particular to simplify and reduce these control and safety systems.

It is an object of the present invention to provide an externally powered automatic weapon in which the firing-control and safety systems can be combined into a single mechanism.

It is another object of the present invention to provide an externally powered weapon of this type wherein the firing-control and safety means comprise a single actuator and a single element locking the moving parts of the weapon.

Hence, the invention proposes a control and safety device for an externally powered automatic weapon comprising at least one rotor driven by a motor to convey ammunition to a firing location, fire the ammunition, and eject the shells after firing. The rotor has at least one stop able to abut a locking moving part displaceable by a detent lever between a stopping position in which it causes the rotor to stop and a weapon-operating position in which it distances itself from the stop and allows rotation of the rotor. A return spring continuously urges the locking part into its stopping position. The locking part is subjected to the action of a second lever displaceable by control means between a resting position and an active position in which it distances the locking part from the action of the detent lever and brings it into the rotor stopping position. The control means of the second lever comprises both a cam, driven by the rotor and causing the second lever to pass from its resting position into the active position when ammunition is brought to the firing location, and displacement means, whose displacement results from the firing of ammunition, causing the second lever to pass from its active position into its resting position.

The firing-control means, including the detent lever, and the "hang fire" safety means, thus act on the same part locking the rotor of the weapon, and are combined into a single device. This reduces the size, the number of actuators, and the likelihood of the weapon malfunctioning, since firing is automatically stopped if a piece of ammunition hangs fire.

According to another embodiment of the invention, the detent lever and the second lever are connected to the locking part by a system of links forming an articulated lever. One end of a first link is connected to a first slide, displaceable by the detent lever. The other end of the first link and one end of a second link are connected to the second lever by a common transverse axis. The other end of the second link is connected by a pivot to the locking part.

A second slide, parallel to the first aforementioned slide, connects the locking part to the detent lever and to the first slide, by means of a transverse finger integral with the first slide and guided in an axial hole of the second slide.

Moreover, the first end of the first link is connected to the second slide by another transverse finger guided in an axial hole of the first slide.

In this way, one can fully mechanically and perfectly reliably distance the locking part from the action of the detent lever and keep it in the rotor stopping position by means of the second lever, if a piece of ammunition should malfunction.

According to yet another embodiment of the invention, the second lever is driven from its active position to its resting position by a rotating finger, moved by the recoil of the weapon when ammunition is fired.

Considerable firing safety results, since it is the recoil of the weapon, resulting from firing ammunition, that allows firing to continue.

On the other hand, if the ammunition malfunctions in the firing location, the rotor is automatically stopped by the locking part, without an external power source having to be used.

According to yet another embodiment of the invention, this device includes means for uncoupling the second lever and the locking part from the rotor, and retaining means comprising, for example, a rocker that retains the second lever uncoupled from the locking part allowing the weapon to operate without ammunition or with blanks.

Simple manipulation of the device according to the invention thus allows the weapon to operate without ammunition or with blanks for personnel training.

BRIEF DESCRIPTION OF THE DRAWINGS

The invention will be better understood and other embodiments, details, and advantages thereof will appear more clearly from reading the description hereinbelow provided as an example with reference to the attached drawings, wherein.

DETAILED DESCRIPTION OF PREFERRED EMBODIMENTS

Figure 1:
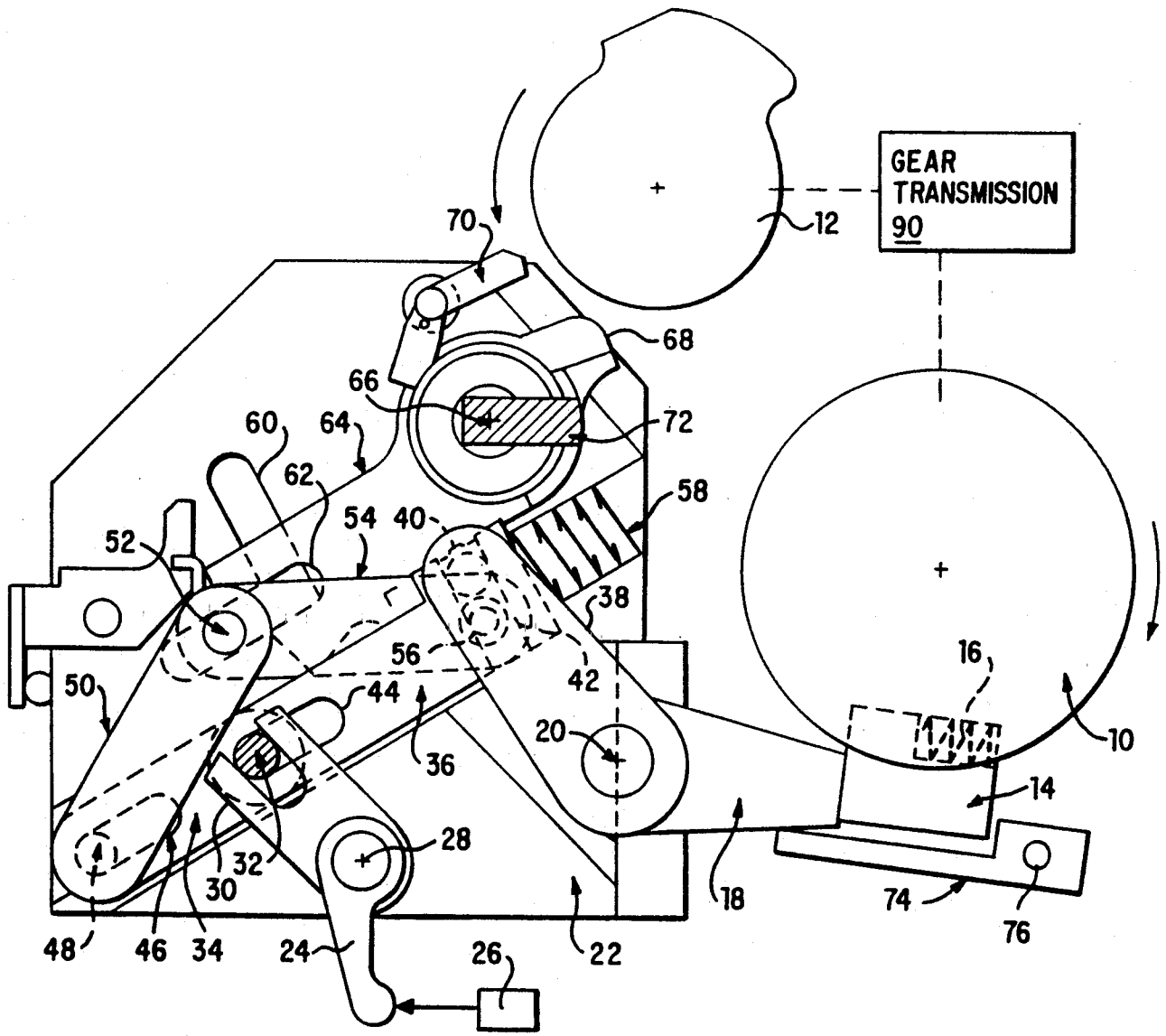
FIG. 1 is a schematic view of one embodiment of the device according to the invention.

In the example shown in the drawings, a weapon equipped with a device according to the invention is an externally powered medium-calibre automatic weapon having a high firing rate, for example several hundred rounds per minute.

This weapon is equipped with a motor driving rotationally a rotor 10 and a cam 12, with the rotor driving the cam and executing for example two complete revolutions and cam 12 a single revolution per firing cycle (including the bringing of ammunition to the firing location, firing of the ammunition, and ejection of the shell after firing). Driving of cam 12 by rotor 10 can be accomplished utilizing a conventional gear transmission 90 having a suitable gear reduction, i.e., in the above example 2:1.

Rotor 10 has on its periphery a stop 14 associated with a damping spring 16 accommodated along with the base of stop 14 in a cavity in the rotor.

This stop 14 is designed to abut the end of a locking part 18 which is mounted to pivot around an axis 20, parallel to the axis of rotor 10, on a plate or a support housing 22, itself mounted on a fixed part of the weapon.

A detent lever 24, associated with an actuator 26 such as an electromagnet for example, is mounted on housing 22 to pivot around an axis 28 parallel to axis 20 to engage, by means of a yoke 30, a transverse finger 32 mounted on a slide 34 displaceable in a rectilinear guide on housing 22. A second slide 36, parallel and partially superimposed on first slide 34, is connected at one end to locking part 18 of which one arm 38 has a crank pin or transverse finger 40 engaged in a transverse groove 42 at the one end of second slide 36. The opposite end of second slide 36 comprises an axial hole 44 which receives transverse finger 32 at one end of first slide 34.

At its opposite end (left end in FIG. 1), first slide 34 itself has an axial hole 46 which receives a transverse pivot 48 on one end of a first link 50 whose other end is articulated on a transverse pivot 52 on one end of a second link 54, the other end of link 54 being articulated at 56 to second slide 36.

A compression return spring 58 constantly urges second slide 36 in the direction which tends to hold locking part 18 in the position shown in FIG. 1, which is a stopping position of rotor 10.

Pivot 52 of links 50 and 54 is itself guided in an L-shaped groove 60 of housing 22, comprising a first leg parallel to slides 34 and 36 and a second, perpendicular leg extending away from the slides. Moreover, this pivot 52 is received in a yoke 62 of a lever 64 rotatably mounted on housing 22 to pivot around an axis 66 parallel to the aforesaid axes and cooperating at one end 68 with cam 12. A tilting catch 70 bears at one end on a shoulder at the periphery of lever 64, holding it in the position shown in FIG. 1, and cooperates at its other end with cam 12. Moreover, a rotating finger 72, shown shaded in the drawing, is associated with a recoiling part of the weapon to cause lever 64 to rotate counterclockwise when a round is fired.

Finally it will be noted that an antireturn system 74 is associated with locking part 18 and allows stop 14 to be retained when the latter rebounds from locking part 18. This system 74 is pivotably mounted on an axis 76 parallel to axis 20 of locking part 18, and abuts this locking part, and is displaced from the path of stop 14 when locking part 18 is itself moved away from this path.

The operation of this device will now be described with reference to FIGS. 2 to 6.

In FIG. 1, the device has been shown in the position it occupies when the weapon is not in use. In this position, locking part 18 is held on the trajectory of stop 14 of rotor 10, by return spring 58 of second slide 36.

Figure 2:
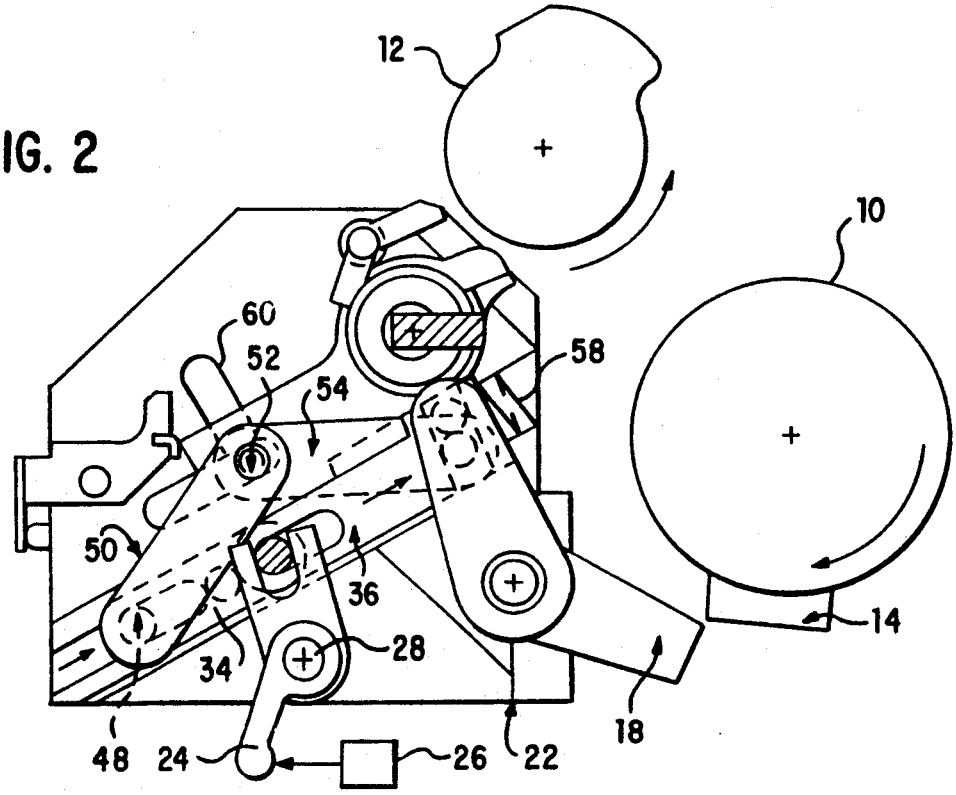
FIGS. 2 to 7 illustrate the operation of the device of FIG. 1.
Figure 3:
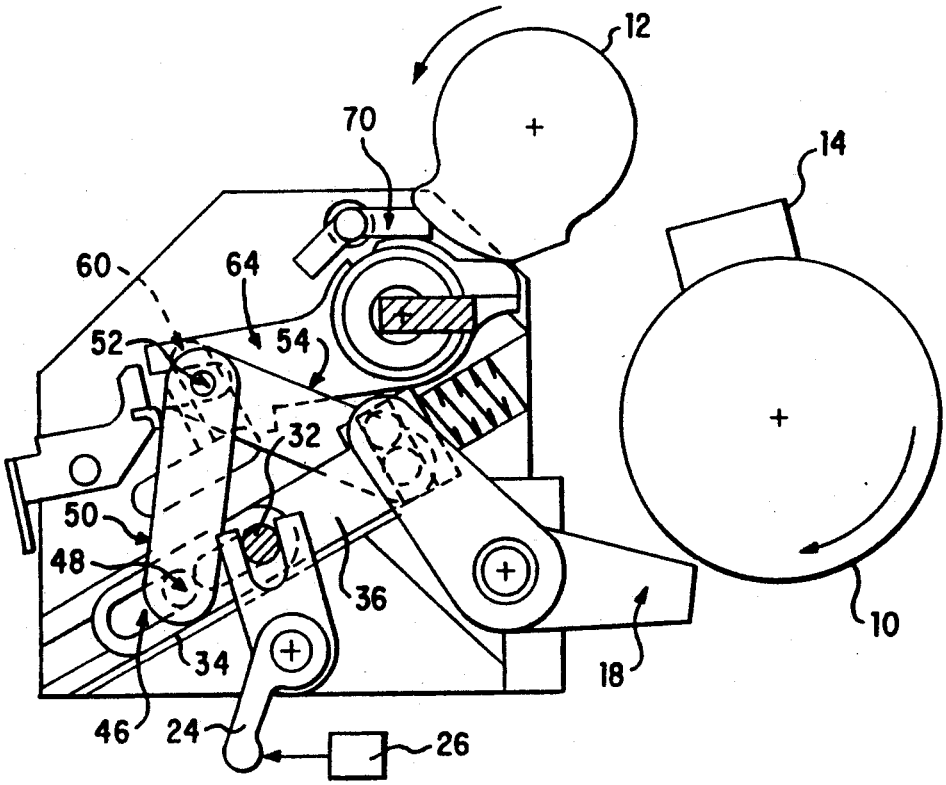

FIG. 2 shows the status of the device when the order to fire is given. Actuator 26 is then excited and causes the detent lever to rotate clockwise around axis 28. This rotation of detent lever 24 results in upward displacement of first slide 34. The lower end of first link 50, whose axis 48 abuts the bottom of hole 46 of the first slide, follows this movement, as shown by the arrow in FIG. 2. The upper end of this link is guided by pivot 52 in the first leg of groove 60 of housing 22, which is parallel to first slide 34. The angle between the two links 50 and 54 is hence unchanged, and as a result, second slide 36 moves upward, with a corresponding rotation of locking part 18 clockwise and compression of return spring 58. Rotation of locking part 18 releases stop 14 of rotor 10 and allows the latter to rotate in the direction indicated by the arrow. This rotation of rotor 10 results in the start of the procedure by which ammunition is brought to the firing location. Cam 12 is also driven rotationally in the direction indicated by the arrow and causes catch 72 and second lever 64 to tilt clockwise before the ammunition is brought into the firing location (FIG. 3). Because of the clockwise rotation of second lever 64, pivot 52 which articulates the two links 50 and 54, held by the yoke of second lever 64, is moved upward in the upper leg of groove 60 of housing 22. Since first slide 34 continues to be held in position by detent lever 24, the two links 50 and 54 move toward each other, pivot 48 of the lower end of first link 50 moves in hole 46 of first slide 34, and the lower end of second link 54 moves second slide 36 downward, said movement being permitted by the relative displacement of transverse finger 32 in axial hole 44 of second slide 36. As a result, locking part 18 rotates counterclockwise, and this part returns to the stopping position of rotor 10.

Figure 4:
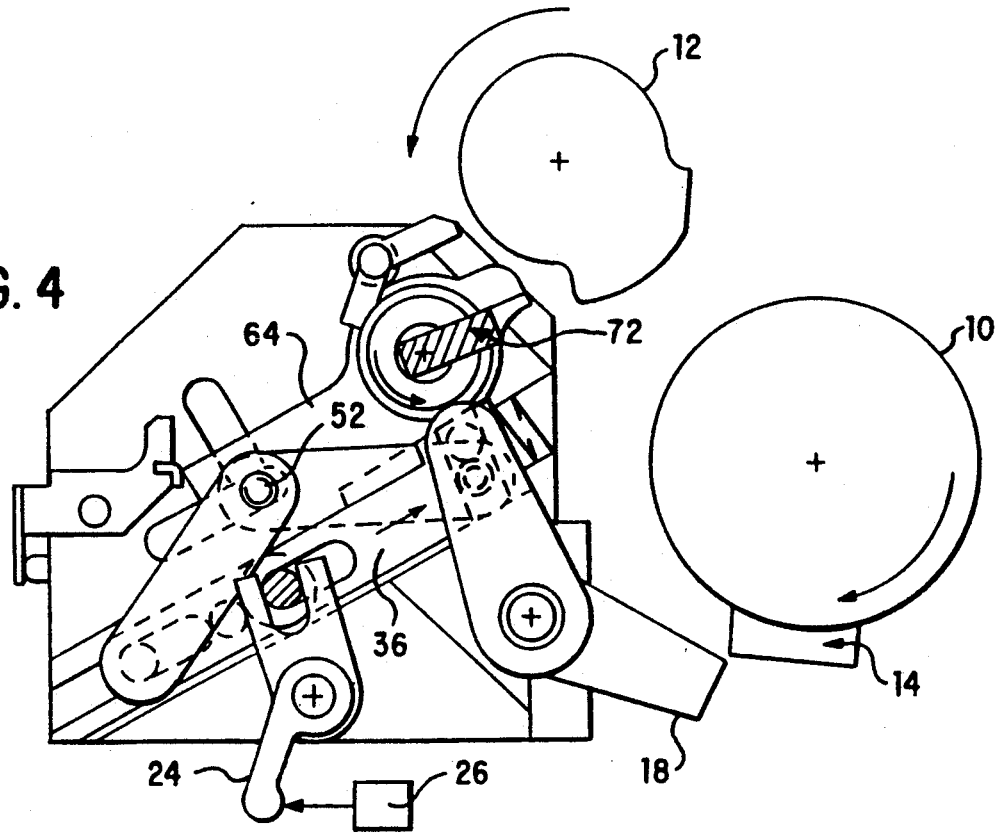
Figure 5:
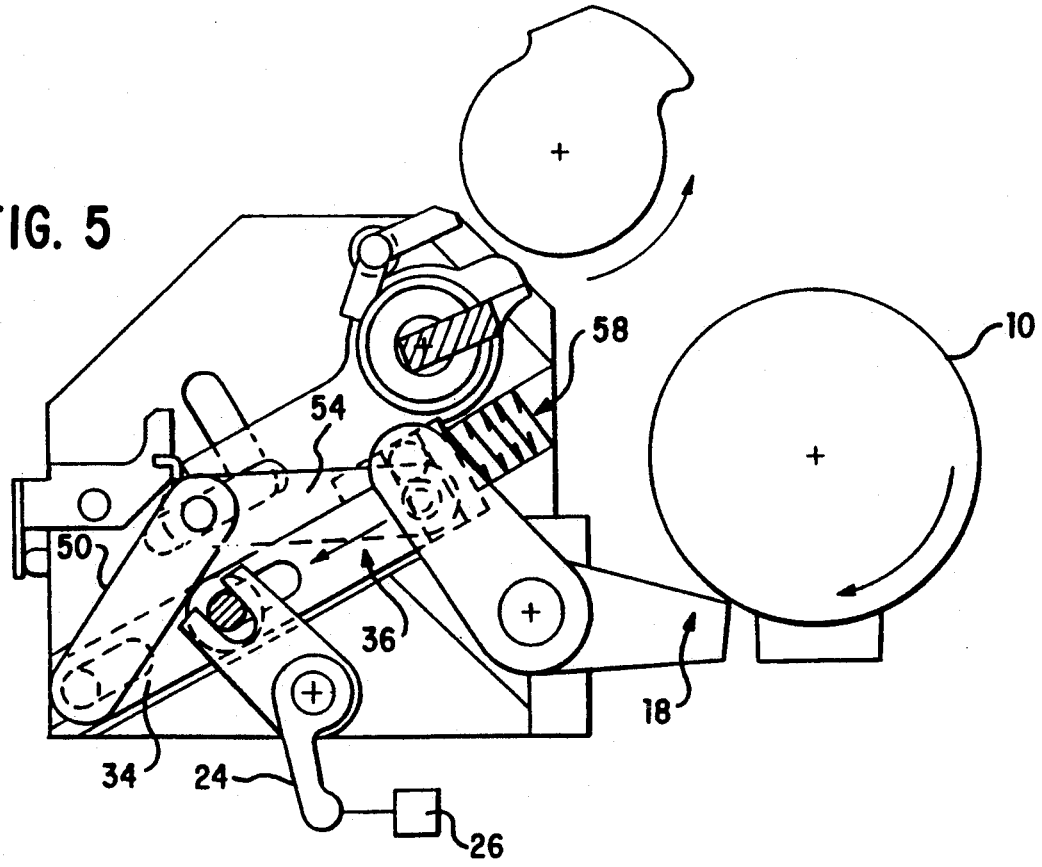

Rotation of rotor 10 continues until stop 14 returns to the vicinity of locking part 18 (FIG. 4). During this rotation, the ammunition has been brought to the firing location and fired. If it operates correctly, the start of the recoil travel of the weapon causes finger 72 to rotate counterclockwise, which results in rotation of second lever 64 in the same direction. Link pivot 52 is then moved to the bottom position, and link 54 moves second slide 36 upward, first slide 34 still being held in the top position by detent lever 24. The upward movement of second slide 36 causes rotation of locking part 18 clockwise, and its displacement out of the path of stop 14 of rotor 10. Rotation of the latter may continue, for a new firing cycle to begin.

At the end of firing (FIG. 5), actuator 26 of the detent lever 24 is de-excited, and detent lever 24 no longer opposes the downward movement of first slide 34. Release of compression spring 58 allows slides 34 and 36 to return to their initial positions in FIG. 1, and locking part 18 to return to the stopping position of rotor 10.

The cease fire signal may be given after the number of rounds fired has been counted. For this purpose, a detector mounted on a moving part that executes one revolution per firing cycle (on cam 12 for example) allows the number of rounds fired to be counted. This number of rounds is compared to a programmed number of rounds and the cease fire signal is given as soon as these numbers are equal.

Figure 6:
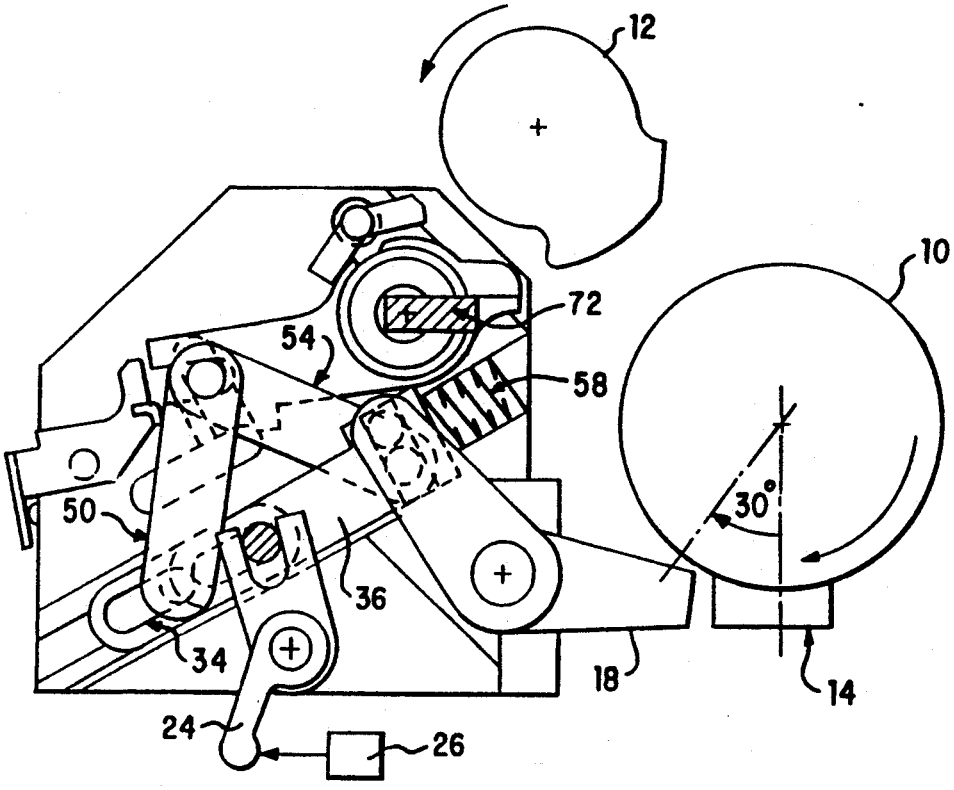

FIG. 6 illustrates the operation of the system when ammunition brought to the firing location has been fired but has not detonated. In this case, rotating finger 72 will not have rotated from the position shown in FIG. 3, and the device remains in the position shown in FIG. 3, in which locking part 18 is in the stopping position of rotor 10. Stop 14 abuts locking part 18, compression spring 16 associated with this stop absorbs the shock over a rotor travel of approximately 30°, then expands and brings the rotor into the stopping position shown in FIG. 6. Antireturn system 74 of FIG. 1 opposes the rebound of stop 14 from part 18.

The weapon control system then deenergizes the actuators.

In this stopping position, return spring 58 of second slide 36 is released and does not allow the device to return to the position in FIG. 1. The device then has to be reset by rotating detent lever 24 counterclockwise, which can be done manually or mechanically, or automatically when actuator 26 of detent lever 24 is of the double-acting type.

In the last case, when the stopping of rotor 10 is detected, the weapon control system begins timing a period after which resumption of firing has a near-zero probability of occurring. At the end of this time, double-acting actuator 26 is energized, first to reset the device by rotating detent lever 24 counterclockwise, then to resume firing, by rotating lever 24 clockwise. The position in FIG. 2 is thus resumed, allowing rotation of rotor 10, ejection of unfired ammunition, and bringing new ammunition to the firing location.

The device according to the invention also allows the weapon to operate without ammunition or with blanks for personnel training.

Figure 7:
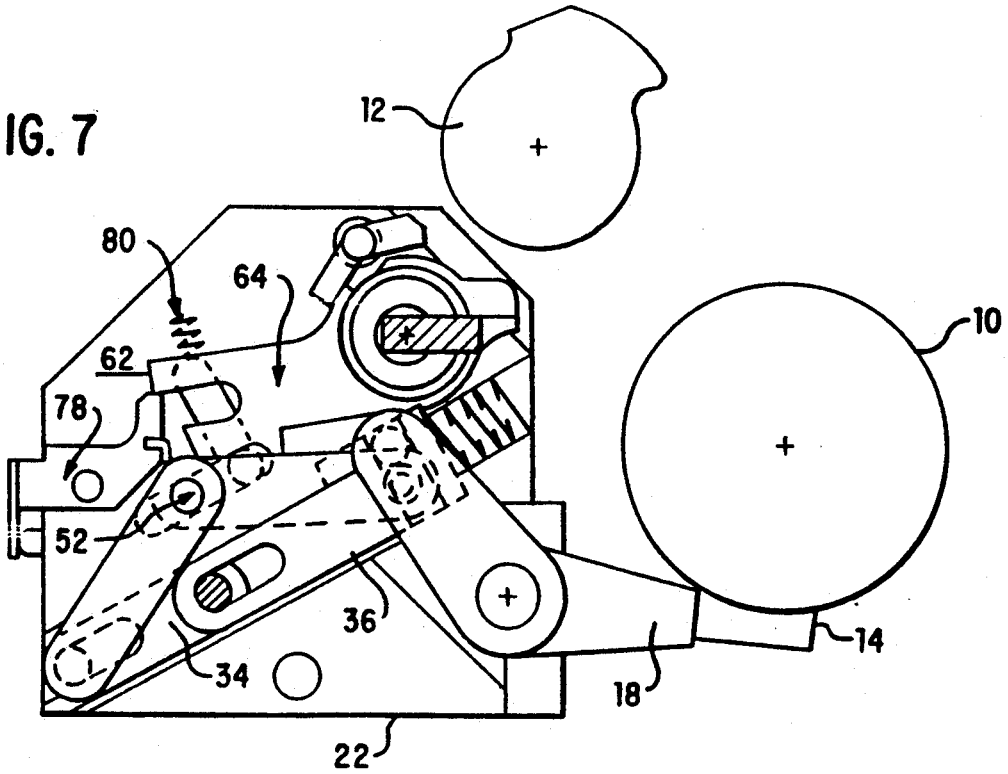

For this purpose, one need only disengage pivot 52 of the links from yoke 62 of second lever 64 and cause this lever 64 to rotate clockwise as shown in FIG. 7. A rocker 78 mounted on housing 22 allows second lever 64 to be held in this position, in which cam 12 has no effect on the second lever.

As a result, the "hang fire" safety system is neutralized. When the firing order is given, simulated firing continues until actuator 26 of detent lever 24 is deexcited.

When the weapon is to be used again with real ammunition, rocker 78 is actuated to release second lever 64 which then reverts to its position in FIG. 1, for example being returned to this position by a return spring 80 (FIG. 7).

What is claimed is:

1. A control and safety device for an externally powered automatic weapon capable of conveying ammunition with shells to a firing location, firing the ammunition, and ejecting the shells after firing, the device comprising:

at least one driven rotor including at least one stop;

a locking moving part abutable with said at least one stop;

a detent lever coupled to said locking part, said detent lever displacing said locking part between a stopping position in which said locking part abuts said at least one stop causing said rotor to stop and a weapon-operating position in which said locking part distances itself from said stop and allows rotation of said rotor;

a return spring coupled to said locking part which continuously urges said locking part into said stopping position;

a control means comprising a cam driven by said rotor and displacement means responsive to firing of ammunition; and a second lever coupled with said locking part and said detent lever, said second lever being displaceable by said control means between a resting position and an active position in which action of said second lever distances said locking part from the action of said detent lever and brings said locking part into said rotor stopping position, said cam of said control means displacing said second lever from said resting position to said active position when ammunition is brought to the firing location and said displacement means responsive to the firing of ammunition displacing said second lever from said active position to said resting position.

2. The device according to claim 1, wherein said second lever is held in said resting position by a rotating catch responsive to said cam driven by said rotor.

3. The device according to claim 1, wherein a shock-absorbing spring is located between said stop and said rotor to absorb shock of said stop as said stop abuts said locking part during rotation of said rotor.

4. The device according to claim 1, including uncoupling means for uncoupling said second lever and said locking part, and retaining means for retaining said second lever uncoupled from said locking part, said uncoupling means and said retaining means allowing the weapon to operate without ammunition or with blanks.

5. The device according to claim 1, wherein said detent lever and said second lever are connected to said locking part by at least a first and second link each having two ends, said links forming an articulated lever, one end of said first link being connected to a first slide, displaceable by said detent lever, the other end of said first link and one end of said second link being connected to said second lever by a common transverse axis, and the other end of said second link being connected by a pivot to said locking part.

6. The device according to claim 5, wherein a second slide, parallel to said first slide, includes an axial hole and said first slide includes an integral transverse finger, said transverse finger being guided by said axial hole connecting said locking part to said detent lever and said first slide.

7. A device according to claim 5, wherein said first end of said first link includes a pivot and said first slide includes an axial hole, said pivot being guided in said axial hole to connect said first end of said first link to said first slide.

8. The device according to claim 5, wherein said device includes a support housing having an L-shaped groove and said second lever includes a yoke, said transverse axis connecting said first link and said second link being guided in said L-shaped groove and received in said yoke.

9. A device according to claim 5, wherein said displacement means includes a rotating finger responsive to recoil of the weapon when ammunition is fired, said rotating finger driving said second lever from said active position to said resting position.

* * * * *